US005338318A

United States Patent [19]

Mercado

[11] Patent Number: 5,338,318

[45] Date of Patent: * Aug. 16, 1994

[54] METHOD FOR DYEING POLYETHYLENE TEREPHTHALATE FILMS

[75] Inventor: Emilio A. Mercado, Roswell, Ga.

[73] Assignee: Acquired Technolgy, Inc., Alpharetta, Ga.

[ * ] Notice: The portion of the term of this patent subsequent to Nov. 10, 2009 has been disclaimed.

[21] Appl. No.: 952,368

[22] Filed: Sep. 28, 1992

Related U.S. Application Data

[63] Continuation-in-part of Ser. No. 767,501, Sep. 30, 1991, Pat. No. 5,162,046.

[51] Int. Cl.[5] ..... D06P 3/52; C09B 67/00

[52] U.S. Cl. ..... 8/512; 8/495; 8/506; 8/582; 8/922; 8/933; 8/938

[58] Field of Search ..... 8/495, 512, 582, 922, 8/933, 938

[56] References Cited

U.S. PATENT DOCUMENTS

| | | | |
|---|---|---|---|
| 2,882,119 | 4/1959 | Laucius | 8/512 |
| 3,034,847 | 5/1962 | Chapman | 8/512 |
| 3,467,481 | 9/1969 | Gold | 8/512 |
| 4,581,035 | 4/1986 | Wilson | 8/508 |
| 4,602,916 | 7/1986 | Wilson | 8/580 |
| 4,609,375 | 9/1986 | Wilson et al. | 8/506 |
| 4,812,142 | 3/1989 | Brodmann | 8/512 |
| 5,162,046 | 11/1992 | Mercado | 8/512 |

*Primary Examiner*—Paul Lieberman
*Assistant Examiner*—Margaret Einsmann
*Attorney, Agent, or Firm*—Ralph H. Dougherty

[57] ABSTRACT

A method of dyeing film of polyethylene terephthalate wherein the film is immersed in a dye bath of solvent or dispersion dyes dissolved in a carrier consisting of glycerol triacetate, the dye bath being heated so the film is raised to the glass transition temperature of the film, and the dye and carrier are absorbed into the film. The dye and carrier are removed from the surface of the film by a washing bath, and the film is then heated to remove the carrier absorbed in the film without depreciating the dyestuff or the film.

10 Claims, 1 Drawing Sheet

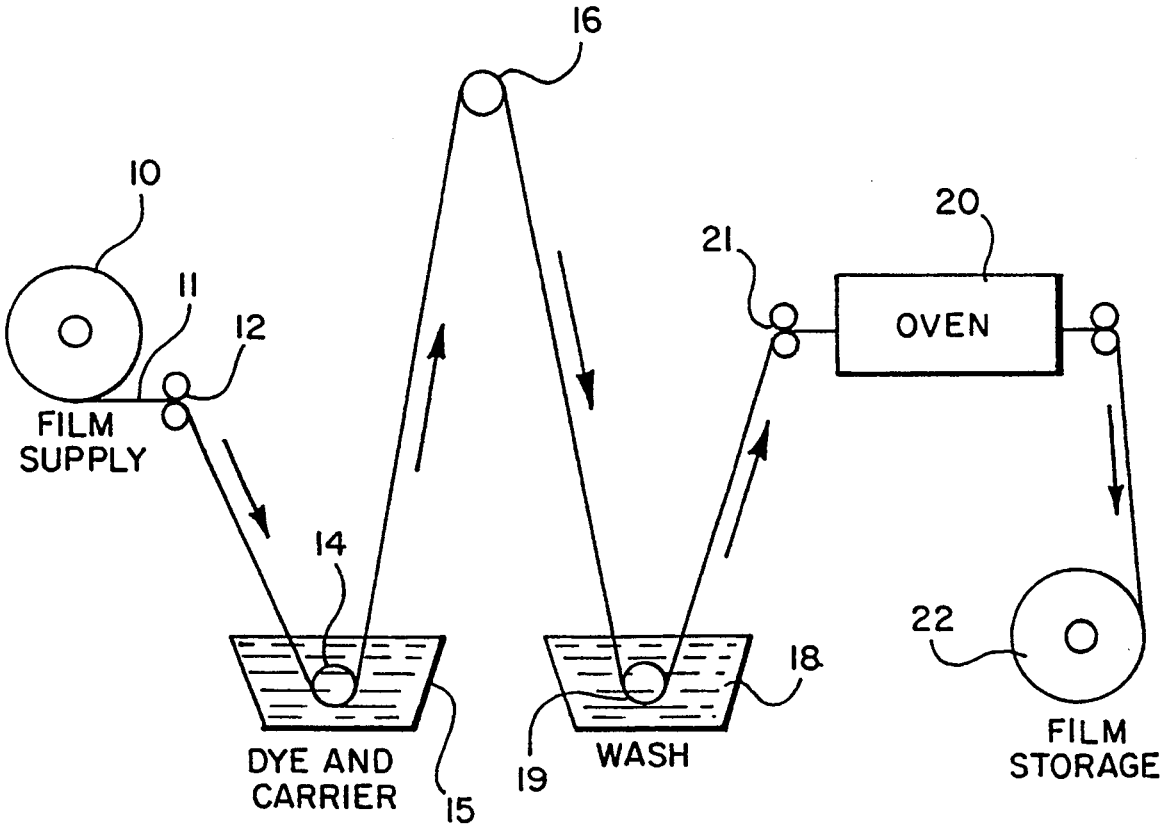
16
10
20
21
11
12
OVEN
FILM
SUPPLY
14
22
18
DYE AND
CARRIER
15
19
WASH
FILM
STORAGE

METHOD FOR DYEING POLYETHYLENE TEREPHTHALATE FILMS

CROSS REFERENCE TO RELATED APPLICATION

This application is a continuation-in-part of my copending U.S. patent application Ser. No. 07/767,501, filed Sep. 30, 1991 now U.S. Pat. No. 5,162,046.

INFORMATION DISCLOSURE STATEMENT

Films made of polyethylene terephthalate (PET) are in common use, and it is frequently desirable to have the films colored. The prior art techniques for coloring PET film include solution dyeing wherein dyes are mixed into the melt before the film is extruded, and a printing technique wherein color is laid onto the film, then set by heat. The solution dyeing yields excellent results, but it is impractical for small quantities of film, and colors cannot easily be changed between runs. The printing technique usually results in film having color on only one side, and it is difficult to get truly uniform color, or level dyeing.

Textile materials of PET are often dyed successfully, achieving level dyeing. Textile materials, however, are made of drawn fibers which are a crystalline form of PET. In the crystalline structure, dyestuff tends to be absorbed along the crystal boundaries. Since the crystalline grains are uniformly distributed throughout the material, the dye tends to be also uniformly distributed, yielding level dyeing. Contrarily, PET film has an amorphous structure. In the amorphous structure, dyestuff tends to be absorbed in the interstices of the polymer chains; and, since these chains are randomly distributed in the film, the dye tends to be randomly distributed, leading to an uneven coloring.

SUMMARY OF THE INVENTION

This invention relates generally to the dyeing of sheet material, and is more particularly concerned with a process for uniformly coloring a film of polyethylene terephthalate.

The present invention provides a method wherein a continuous film of polyethylene terephthalate (PET) is placed into a heated bath containing solvent dyes or disperse dyes in a glycerol triacetate carrier that acts as a solvent or other dispersion vehicle, or both a solvent and dispersion vehicle for the dyes. The film is removed from the dye bath and briefly air dried, then washed in a bath of a solvent that is compatible with the PET film, the carrier and the dyestuffs. The dyed film is then heated to remove the carrier and any residual washing solvent, while leaving the absorbed dyestuffs.

The method of the present invention provides a level dyed PET film having substantially the same quality of the film as before dyeing. The color is uniform immediately after dyeing, and fades uniformly in sunlight or the like.

The invented apparatus includes: film supply means, a dye container having an immersion roll situated therein, a heater associated with the dye container for heating the dye, a guide for guiding film into the dye container and around the immersion roll, a withdrawal roll for removing film from the dye container and for promoting the drying of the film, a wash container having a second immersion roll situated therein, film withdrawal rolls for removing the film from wash container, and an oven for drying the removed film.

BRIEF DESCRIPTION OF THE DRAWING

The foregoing and other features and advantages of the present invention will become apparent from consideration of the following specification when taken in conjunction with the accompanying drawing in which:

The single figure is a schematic diagram showing one form of the apparatus for carrying out the method of the present invention.

DETAILED DESCRIPTION

Referring now to the drawing, and particularly to that embodiment of the invention here chosen by way of illustration, the drawing shows a roll 10 of PET film as a source of film. Those skilled in the art will understand that any other source of film may be substituted, including an extrusion line so the film is dyed in line from the extruder.

From the roll 10, the film 11 passes through the nip of rolls 12 which will drive the film at the appropriate speed, and act as guide means for directing the film down to the immersion roll 14. The immersion roll 14 is within the container 15 so the film 11 is carried through the bath. The container 15 receives the solution of a high boiling carrier and dyestuffs. The bath is heated, so film 11 is heated to be more receptive to absorption of the liquid. It will be understood that the size of the container 15 and the speed of the film 11 can be varied to provide for the required immersion times to achieve the desired intensity of dyeing.

When the film 11 leaves the container 15, the film is directed over a roll 16, then to a second container 18 having an immersion roll 19 therein. The roll 16 is sufficiently far removed from the containers 15 and 18 to allow time for the film to dry before the film is immersed in the container 18.

The container 18 holds a washing liquid that is a solvent for the dyestuffs and for the carrier, but that will not attack or damage the PET film. The object of this washing step is to remove the excess dye and carrier that adheres to the surface of the film 11, while leaving the material that is absorbed into the film.

Upon removal from the container 18, the film 11 is directed into an oven 20 by rolls 21. The purpose of the oven is to remove the carrier from the film 11 while leaving the dyestuffs. Thus, the temperature of the oven 20 is above the flash point of the carrier, but the film will not be heated sufficiently to damage the film or the dyestuffs.

After the film 11 passes through the oven 20, it is directed to a roll 22 as a storage means, or to further processing if the dyeing process is being operated in line.

In the above described process, the first important feature is the dye bath, which contains the carrier and the dyestuffs. The dyestuffs are either solvent dyes, which are the same dyes used in solution dyeing of the film, adding color to the plastic melt, or disperse dyes. The dyestuffs must have an acceptability or affinity towards polyethylene terephthalate. Solvent dyes include colors of the azo, quinoline anthraquinone, xanthene, aminoketone, perinone and azine chemical classes. Specific examples of solvent dyes for use in the present invention are as follows, listed by color index name:

| | |
|---|---|
| Solvent yellow | 33 |
| Solvent red | 23 |
| Solvent red | 24 |
| Solvent red | 111 |
| Solvent green | 3 |
| Solvent orange | 60 |
| Solvent blue | 11 |
| Solvent blue | 60 |
| Solvent blue | 102 |
| Solvent black | 5 |
| Solvent black | 7 |
| Solvent red | 1 |
| Solvent yellow | 14 |
| Solvent yellow | 16 |
| Solvent brown | 11 |

The carrier is either a solvent, or a dispersant, or both a solvent and dispersant for the dyestuffs, and must have a boiling point sufficiently high enough to allow appropriate heating of the carrier for the desired treatment temperature. The temperature range is generally in the range of the glass transition temperature for PET. The preferred treatment range is from 140° C. to 180° C. If the thickness of the film is below one mil (0.001"), the temperature will be in the lower end of the range.

The carrier for use in the present invention is a high-boiling-point liquid polyhydric ester. Although the carrier may be any one of the esters of glycerol, the preferred carrier is glycerol triacetate, which is also known as triacetin. Though the esters of glycerol in general will effect an acceptable dyeing of PET film in the process of the present invention, the use of triacetin yields superior results. Triacetin yields excellent saturation and levelness with a very short immersion time, and will dissolve solvent dyes at room temperature. Glycerol triacetate has such an acceptability towards polyethylene terephthalate that it provides a versatile and convenient vehicle to achieve diffusion of dyestuffs into the polymer substrate. Its thermal and chemical properties are uniquely compatible with the void generation phenomena produced by heating thermoplastics within their glass transition ranges. Further, triacetin has a sufficiently high boiling point to allow treatment within a desirable operating range, but to be removed by temperatures in an acceptable range that will not damage the PET film or the dyestuffs.

The dyestuffs do not chemically react with glycerol triacetate so as to decompose or alter the molecular structure of glycerol triacetate at processing temperatures. Nor do the dyestuffs chemically react with glycerol triacetate so as to decompose and alter the molecular structure of the dyestuffs themselves.

The theory to which I subscribe, but do not wish to be held, is that the dyestuffs dissolve in glycerol triacetate, thus achieving a complete solution at processing temperatures. Dyestuffs form a dispersion via mechanical agitation in glycerol triacetate at processing temperatures. Further, the dyestuffs form a dispersion via chemical means in glycerol triacetate at processing temperatures. It may be possible that the dyestuffs form a colloidal suspension in glycerol triacetate via mechanical agitation at processing temperatures and that the dyestuffs form a colloidal suspension in glycerol triacetate via chemical means at processing temperatures. Therefore, dyestuffs must withstand all processing temperatures (processing temperatures are defined as those temperatures encountered in all steps of the process ranging from room temperature to the maximum 180 degrees centigrade).

In preparing the dye bath, for light colors, the concentrations may be in the range of 2 to 40 grams of dyestuff per liter of carrier. The temperature of the bath may be from 140° to 180° C., and the required contact time is 5 seconds to 10 seconds. For deeper colors, the concentration can be increased to a range of 40 to 110 grams per liter with a temperature in the range of 140° to 180° C. The contact time may then be from 10 to 90 seconds.

The temperature of the dye bath is sufficient in the allotted time to raise the PET film to the glass transition temperature. In this range, the PET material expands to allow the dye bath to enter the material. Since the dyestuffs are in solution in the carrier, it will be understood that both the carrier and the dyestuff enters the PET film.

After the treatment in the dye bath, the PET film is removed and allowed to dry somewhat. At this point, the film 11 includes the solution of dye and carrier within the film, and also includes a quantity of the solution of dye and carrier adhering to the surface of the film. The solution adhering to the surface of the film is not necessarily uniformly distributed, so it is important to remove such material. To do so, the film is immersed in a washing bath 18.

The washing bath preferably comprises a material that will dissolve the adhering solution of dye and carrier, but will not attack, or degrade, the PET film. The washing bath should be a low boiling point liquid so it can be easily removed from the film. The alkane alcohols fit this description, and it has been found that ethanol yields excellent results. Methyl ethyl ketone (MEK) also yields satisfactory results.

After the film has been washed in the washing bath, the film is heated, as by the oven 20. Before the film 11 reaches the oven 20, the adherent dye solution has been removed by the washing bath; and, the washing bath is sufficiently volatile that it is easily removed. Those skilled in the art will realize that triacetin is a plasticizer for PET, so the presence of some triacetin within the film 11 will alter the physical properties of the film. One of the objects of the present invention is to produce dyed film that is substantially like the film before dyeing. Thus, the triacetin should be removed from the film 11. It is contemplated that the final heat treatment in the oven 20 will be carried out around 149° C. or above, and the film will be subjected to this temperature for about 3 to 30 seconds. If production demands require, the temperature may be increased, but the temperature should not exceed 175° C. because it is important not to cause any degradation of the PET film.

The heat treatment in the oven 20 is intended to remove the carrier from the film 11 without depreciating the film or the dyestuffs absorbed in the film. The flash point temperature of triacetin is within the glass transition temperature range of PET. Therefore, so long as the selected dyestuffs can withstand this temperature range, the PET film can be dyed, and finally treated for removal of the carrier without damage to the film or the dyestuffs.

During the final heat treatment, it has been found that there is little or no dye migration. It is not known if the dyestuffs are simply physically trapped within the polymer voids, or if the dye is chemically attached to the polymer molecules, but the high quality of dyeing is not degraded by the final heat treatment.

In carrying out the present invention, it should be understood that the dyestuffs can be mixed, or blended, to create the desired color, and the process works quite well. Also, in order to change colors, one must merely change the dye bath 15 and the wash bath 18, so a complete color change can be done quickly and easily. As a result, very short runs can be provided economically using the method of the present invention. A particular color mixture can even be saved for subsequent runs of the same color, and only the washing bath must be discarded.

Two specified examples of dyeing PET films with dispersed dyes follow.

EXAMPLE 1

A dye liquor was made by adding 20 grams of disperse yellow #42 to 750 ml of glycerol triacetate. The liquor was then heated to 150 degrees centigrade during which it was mechanically agitated to obtain a dispersion and/or solution. The dye liquor was then filtered removing any impurities or residues. The resultant dye liquor was then heated to and maintained at 180 degrees centigrade. An undyed sample of 1 mil thick polyethylene terephthalate film was immersed in the dye liquor for 60 seconds then the sample was rinsed with anhydrous ethanol removing any dye liquor adhering to the surface of the film sample. The sample was then subjected to the heat treatment by convection for 15 seconds at 170 degrees centigrade flashing or vaporizing the entrapped residual glycerol triacetate. An even yellow color was obtained.

EXAMPLE 2

A dye liquor was made by adding 30 grams of terasil brilliant violet BL paste to 750 ml of glycerol triacetate. 20 ml of dimethyl ketone was then added to the dye liquor to aid in the dispersion and/or solution of the dyestuff in the glycerol triacetate. The dye liquor was subjected to vigorous mechanical agitation as it was slowly heated to 50 degrees centigrade. The dye liquor was then heated to the boiling point of dimethyl ketone until all of the dimethyl ketone had evaporated from the dye liquor. The resultant dye liquor was then heated to and maintained at 180 degrees centigrade. An undyed sample of 2 mil thick polyethylene terephthalate film was immersed in the dye liquor for 60 seconds then the sample was rinsed with anhydrous ethanol removing any dye liquor adhering to the surface of the film sample. The sample was then subjected to the heat treatment by convection for 25 seconds at 170 degrees centigrade flashing or vaporizing the entrapped residual glycerol triacetate. An even deep violet color was obtained.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as set forth in the appended claims.

I claim:

1. The method for dyeing polyethylene terephthalate film comprising the steps of heating said film to a first temperature within the range of the glass transition temperature of said film, contacting said film with dye selected from the group consisting of solvent dyes, disperse dyes, and mixtures thereof, said dye being dissolved, dispersed, in a colloidal suspension, or both dissolved and dispersed in a carrier while maintaining said film at said temperature within the range of the glass transition temperature of said film, removing dye and carrier from the surface of said film, and subsequently raising said film to a second temperature at least as high as the flash point of the carrier to remove the carrier absorbed in said film, said carrier consisting of any ester of glycerol.

2. The method according to claim 1, wherein the step of removing dye and carrier from the surface of said film includes the step of immersing said film in a washing bath, said washing bath comprises a material that will dissolve the adhering solution or dye and carrier.

3. The method according to claim 2, wherein said washing bath is selected from the group consisting of ethanol and methyl ethyl ketone.

4. The method according to claim 3, wherein said washing bath consists of ethanol.

5. The method according to claim 1, wherein the step of heating said film to a second temperature comprises passing said film through an oven.

6. The method according to claim 5, wherein the oven is heated to a temperature in the range of the glass transition temperature of said film.

7. The method according to claim 6, wherein from 2 to 110 grams of dye is employed per liter of carrier.

8. The method according to claim 7, wherein said film is contacted with dye in a carrier for a period of time from 5 seconds to 90 seconds.

9. The method according to claim 1, wherein said carrier is glycerol triacetate.

10. The method according to claim 2, wherein said washing bath is selected from the group consisting of alkane alcohols and methyl ethyl ketone.

* * * * *